US011831104B2

(12) United States Patent
Zhao et al.

(10) Patent No.: US 11,831,104 B2
(45) Date of Patent: Nov. 28, 2023

(54) DIRECT CURRENT PLUG, DIRECT CURRENT SOCKET AND ELECTRIC EQUIPMENT

(71) Applicant: Gree Electric Appliances, Inc. of Zhuhai, Guangdong (CN)

(72) Inventors: Zhigang Zhao, Guangdong (CN); Lei Li, Guangdong (CN); Jinrong Yuan, Guangdong (CN); Qiulian Li, Guangdong (CN); Xiangqian Li, Guangdong (CN)

(73) Assignee: Gree Electric Appliances, Inc. of Zhuhai, Guangdong (CN)

( * ) Notice: Subject to any disclaimer, the term of this patent is extended or adjusted under 35 U.S.C. 154(b) by 260 days.

(21) Appl. No.: 17/295,388

(22) PCT Filed: Jul. 31, 2019

(86) PCT No.: PCT/CN2019/098496
§ 371 (c)(1),
(2) Date: May 19, 2021

(87) PCT Pub. No.: WO2020/134073
PCT Pub. Date: Jul. 2, 2020

(65) Prior Publication Data

US 2022/0006241 A1 Jan. 6, 2022

(30) Foreign Application Priority Data

Dec. 24, 2018 (CN) ..... 201811581656.1

(51) Int. Cl.
*H01R 13/64* (2006.01)
*H01R 13/645* (2006.01)
*H01R 24/28* (2011.01)

(52) U.S. Cl.
CPC ..... *H01R 13/6453* (2013.01); *H01R 24/28* (2013.01)

(58) Field of Classification Search
CPC ..... H01R 13/6453; H01R 24/28
(Continued)

(56) References Cited

U.S. PATENT DOCUMENTS 4,546,414 A * 10/1985 Donges ..... H05K 7/1455 439/631
6,530,793 B2 * 3/2003 Eichhorn ..... H01R 24/60 439/660

(Continued)

FOREIGN PATENT DOCUMENTS

CN 1370343 A 9/2002
CN 201430325 Y 3/2010

(Continued)

*Primary Examiner* — Abdullah A Riyami
*Assistant Examiner* — Vladimir Imas
(74) *Attorney, Agent, or Firm* — The Webb Law Firm

(57) ABSTRACT

The present disclosure relates to a direct current (DC) plug, a DC socket and electric equipment. The DC plug is configured to be connected to a DC socket to supply power to an electrical equipment. The DC plug includes: a center contact, including a first center contact side surface, a second center contact side surface, a third center contact side surface and a fourth center contact side surface, wherein the first center contact side surface and the second center contact side surface are oppositely disposed, and the third center contact side surface and the fourth center contact side surface are oppositely disposed; first plug current conductors, disposed on the first center contact side surface and the second center contact side surface; and second plug current conductors, disposed on the third center contact side surface and the fourth center contact side surface.

18 Claims, 4 Drawing Sheets

(58) Field of Classification Search
USPC ..... 439/677
See application file for complete search history.

(56) References Cited

U.S. PATENT DOCUMENTS

| | | | | |
|---|---|---|---|---|
| 10,461,453 | B2 * | 10/2019 | Liu | H01R 13/10 |
| 10,765,015 | B2 * | 9/2020 | Linderman | H01R 24/28 |
| 11,503,724 | B2 * | 11/2022 | Linderman | H05K 5/0026 |
| 2002/0081880 | A1 | 6/2002 | Eichhorn et al. | |

FOREIGN PATENT DOCUMENTS

| | | | |
|---|---|---|---|
| CN | 205960357 | U | 2/2017 |
| CN | 109449698 | A | 3/2019 |
| DE | 10325651 | A1 | 12/2004 |
| KR | 101801136 | B1 | 12/2017 |

* cited by examiner

DIRECT CURRENT PLUG, DIRECT CURRENT SOCKET AND ELECTRIC EQUIPMENT

CROSS REFERENCE TO RELATED APPLICATIONS

This application is the United States national phase of International Application No. PCT/CN2019/098496 filed Jul. 31, 2019, and claims the priority of Chinese application No. 201811581656.1, filed on Dec. 24, 2018, the disclosures of which are incorporated herein in their entirety.

BACKGROUND

Field of the Invention

The present disclosure relates to the field of electric appliances, in particular to a direct current (DC) plug, a DC socket and electric equipment.

Description of Related Art

With the development of power and clean energy, the application requirements of DC microgrid systems and DC appliances involve DC interface accessories as a bridge between the DC appliances and DC microgrids. The current DC interface is a modified version of an aviation plug and a panel, which is not representative of a DC system.

Furthermore, the aviation plug is an industrial application product, which is complicated to use, heavy in weight and high in cost, and is not suitable for daily use. In related arts, DC plugs and sockets designed following three-phase alternative current (AC) plugs and sockets adopt the structural form of plug pins and jacks, and are easily confused in life. Therefore, under the voltage levels of 400 VDC and 48 VDC determined currently, it is necessary to creatively develop representative interfaces (DC plugs and DC sockets) of the DC system.

SUMMARY OF THE INVENTION

According to an aspect of some embodiments of the present disclosure, a DC plug configured to be connected to a DC socket to supply power to an electrical equipment. The DC plug includes: a center contact, including a first center contact side surface, a second center contact side surface, a third center contact side surface and a fourth center contact side surface, wherein the first center contact side surface and the second center contact side surface are oppositely disposed, and the third center contact side surface and the fourth center contact side surface are oppositely disposed; first plug current conductors, disposed on the first center contact side surface and the second center contact side surface; and second plug current conductors, disposed on the third center contact side surface and the fourth center contact side surface, wherein the first plug current conductors are configured to be connected to one of a positive pole and a negative pole of a power source, and the second plug current conductors are configured to be connected to the other of the positive pole and the negative pole of the power source.

In some embodiments, the first center contact side surface and the second center contact side surface are arc-shaped surfaces; and/or the third center contact side surface and the fourth center contact side surface are arc-shaped surfaces.

In some embodiments, the first center contact side surface and the second center contact side surface are arc-shaped surfaces recessed towards an inside of the center contact; and/or the third center contact side surface and the fourth center contact side surface are arc-shaped surfaces recessed towards the inside of the center contact.

In some embodiments, the first plug current conductor disposed on the first center contact side surface and the first plug current conductor disposed on the second center contact side surface are symmetrically disposed; and/or the second plug current conductor disposed on the third center contact side surface and the second plug current conductor disposed on the fourth center contact side surface are symmetrically disposed.

In some embodiments, all the center contact side surfaces are each provided with a plurality of plug current conductors, the plurality of plug current conductors on a same center contact side surface are arranged in sequence and are symmetrical with respect to a center line of this center contact side surface, and distances from the center line of the center contact side surface to two ends of the center contact side surface are equal.

In some embodiments, the number of the first plug current conductors disposed on the first center contact side surface is equal to the number of the first plug current conductors disposed on the second center contact side surface; and/or the number of the second plug current conductors disposed on the third center contact side surface is equal to the number of the second plug current conductors disposed on the fourth center contact side surface.

In some embodiments, the first center contact side surface and the second center contact side surface are each provided with at least three first plug current conductors, and a length of each of the first plug current conductors located in two end regions of a same center contact side surface is greater than a length of each of the first plug current conductors located in a middle region.

In some embodiments, the DC plug further includes third plug current conductors, the first center contact side surface and the second center contact side surface are each provided with at least two first plug current conductors, the first plug current conductors located on a same center contact side surface are connected to a same third plug current conductor, and the third plug current conductors are each provided with a wiring port for connection with a cable.

In some embodiments, the DC plug further includes a plug insulating portion connected to a fifth center contact side surface of the center contact, and the plug insulating portion encloses the third plug current conductors and ends of the first plug current conductors connected to the third plug current conductors.

In some embodiments, one end of the second plug current conductor is disposed in the plug insulating portion, and this end is provided with a wiring port for connection with a cable.

In some embodiments, the first center contact side surface, the third center contact side surface, the second center contact side surface and the fourth center contact side surface are connected in sequence; the first center contact side surface and the second center contact side surface are symmetrically disposed, and are arc-shaped surfaces recessed towards an inside of the center contact; and the third center contact side surface and the fourth center contact side surface are symmetrically disposed, and are arc-shaped surfaces recessed towards the inside of the center contact.

In some embodiments, a connection between the first center contact side surface and the third center contact side surface, a connection between the third center contact side surface and the second center contact side surface, a connection between the second center contact side surface and the fourth center contact side surface, and a connection between the fourth center contact side surface and the first center contact side surface are all arc-shaped transitional connection.

In some embodiments, a distance between two ends of the first center contact side surface is equal to a distance between two ends of the second center contact side surface; and/or a distance between two ends of the third center contact side surface is equal to a distance between two ends of the fourth center contact side surface.

In some embodiments, the distance between the two ends of the first center contact side surface is greater than the distance between the two ends of the third center contact side surface.

According to an aspect of some embodiments of the present disclosure, a DC socket is configured to match with a DC plug to supply power to an electrical equipment. The DC socket includes: a slot, including a first slot side surface, a second slot side surface, a third slot side surface and a fourth slot side surface, wherein the first slot side surface and the second slot side surface are oppositely disposed, and the third slot side surface and the fourth slot side surface are oppositely disposed; first socket current conductors, disposed on the first slot side surface and the second slot side surface; and second socket current conductors, disposed on the third slot side surface and the fourth slot side surface, wherein the first socket current conductors are configured to be connected to one of a positive pole and a negative pole of a power source, and the second socket current conductors are configured to be connected to the other of the positive pole and the negative pole of the power source.

In some embodiments, the first slot side surface and the second slot side surface are arc-shaped surfaces; and/or the third slot side surface and the fourth slot side surface are arc-shaped surfaces.

In some embodiments, the first slot side surface and the second slot side surface are arc-shaped surfaces recessed towards an inside of the slot; and/or the third slot side surface and the fourth slot side surface are arc-shaped surfaces recessed towards the inside of the slot.

In some embodiments, the first socket current conductor disposed on the first slot side surface and the first socket current conductor disposed on the second slot side surface are symmetrically disposed; and/or the second socket current conductor disposed on the third slot side surface and the second socket current conductor disposed on the fourth slot side surface are symmetrically disposed.

In some embodiments, all the slot side surfaces are each provided with a plurality of socket current conductors, the plurality of socket current conductors on a same slot side surface are arranged in sequence and are symmetrical with respect to a center line of this slot side surface, and distances from the center line of the slot side surface to two ends of the slot side surface are equal.

In some embodiments, the number of the first socket current conductors disposed on the first slot side surface is equal to the number of the first socket current conductors disposed on the second slot side surface; and/or the number of the second socket current conductors disposed on the third slot side surface is equal to the number of the second socket current conductors disposed on the fourth slot side surface.

In some embodiments, the first slot side surface and the second slot side surface are each provided with at least three first socket current conductors, and a length of each of the first socket current conductors located in two end regions of a same slot side surface is greater than a length of each of the first socket current conductors located in the middle region.

In some embodiments, the DC socket further includes third plug current conductors, the first slot side surface and the second slot side surface are each provided with at least two first socket current conductors, the first socket current conductors located on a same slot side surface are connected to a same third socket current conductor, and the third socket current conductors are each provided with a wiring port for connection with a cable.

In some embodiments, the DC socket further includes a socket insulating portion, the slot is disposed in the socket insulating portion, and the socket insulating portion coats the third socket current conductors and the ends of the first socket current conductors connected to the third socket current conductors.

In some embodiments, one end of each second socket current conductor is disposed in the socket insulating portion, and this end is provided with a wiring port for connection with a cable.

In some embodiments, the first slot side surface, the third slot side surface, the second slot side surface and the fourth slot side surface are connected in sequence; the first slot side surface and the second slot side surface are symmetrically disposed, and are arc-shaped surfaces recessed towards an inside of the slot; and the third slot side surface and the fourth slot side surface are symmetrically disposed, and are arc-shaped surfaces recessed towards the inside of the slot.

In some embodiments, a connection between the first slot side surface and the third slot side surface, a connection between the third slot side surface and the second slot side surface, a connection between the second slot side surface and the fourth slot side surface, and a connection between the fourth slot side surface and the first slot side surface are all arc-shaped transitional connection.

In some embodiments, a distance between two ends of the first slot side surface is equal to a distance between two ends of the second slot side surface; and/or a distance between two ends of the third slot side surface is equal to a distance between two ends of the fourth slot side surface.

In some embodiments, the distance between the two ends of the first slot side surface is greater than the distance between the two ends of the third slot side surface.

According to an aspect of some embodiments of the present disclosure, an electric equipment includes the aforementioned DC plug and/or the aforementioned DC socket.

According to an aspect of some embodiments of the present disclosure, the DC plug includes the center contact, one pair of opposite side surfaces of the center contact is provided with the first plug current conductors, and the other pair of opposite side surfaces of the center contact is provided with the second plug current conductors, and the first plug current conductors and the second plug current conductors are adapted to achieve connection with the positive pole and the negative pole of the power source. The form of the DC plug is obviously different from interface products set according to the form of three-phase AC plugs and sockets in the related arts, and adopt to avoid confusion with the three-phase AC plugs and sockets.

DETAILED DESCRIPTION OF THE INVENTION

Figure 1:
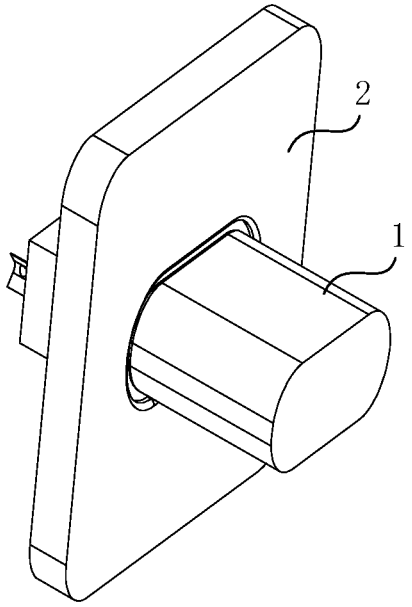
FIG. 1 is a schematic diagram showing the assembly of a DC plug and a DC socket according to some embodiments of the present disclosure.

The technical solutions in the embodiments of the present disclosure will be clearly and completely described below in conjunction with the accompanying drawings in the embodiments of the present disclosure. Apparently, the embodiments described are merely part of the embodiments of the present disclosure, rather than all of the embodiments. All other embodiments obtained by those of ordinary skill in the art based on the embodiments of the present disclosure without creative efforts fall within the protection scope of the present disclosure.

In the description of the present disclosure, it should be understood that the directional or positional relationships indicated by terms "center", "longitudinal", "lateral", "front", "rear", "left", "right", "vertical", "horizontal", "top", "bottom", "inner", "outer", etc. are directional or positional relationships shown in the drawings, which are merely for the purpose of facilitating the description of the present disclosure and simplification of the description, instead of indicating or implying that the referred devices or elements must have specific directions or be constructed and operated in specific directions, and thus cannot be construed as limitations to the protection scope of the present disclosure.

The present disclosure is adapted to relieve the problem that a DC plug is easily confused with an alternative current (AC) in related arts.

Figure 2:
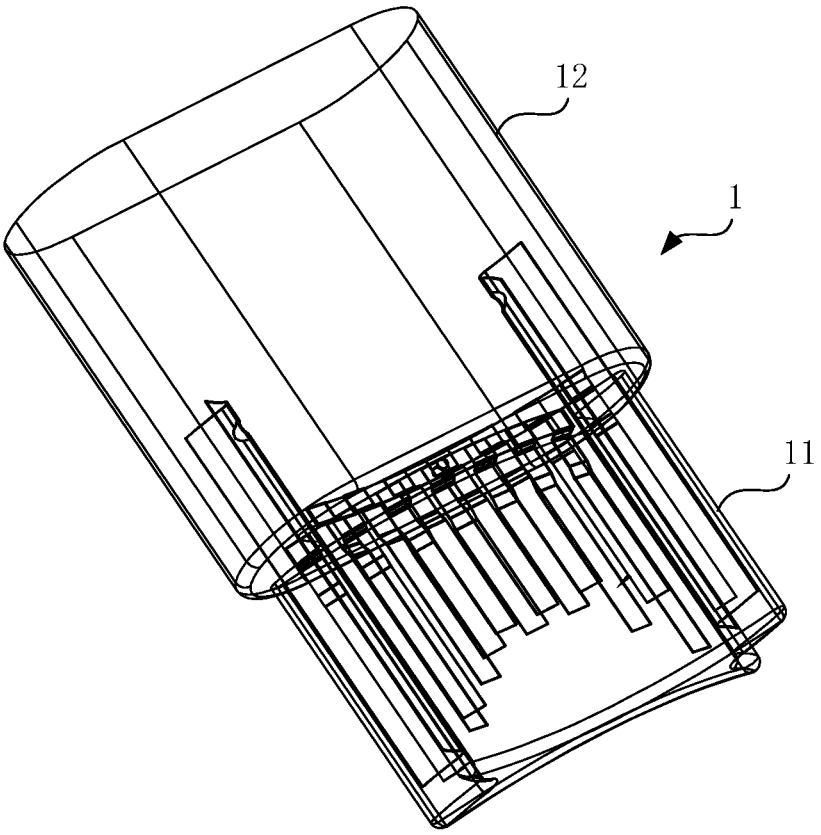
FIG. 2 is a schematic diagram showing the DC plug according to some embodiments of the present disclosure.

As shown in FIGS. 1 and 2, some embodiments provide a DC plug, which is configured to be connected to a DC socket 2 to supply power to an electrical equipment.

In some embodiments, as shown in FIG. 2, the DC plug 1 includes a center contact 11. Furtherly, the center contact 11 is made of an insulating material.

Figure 3:
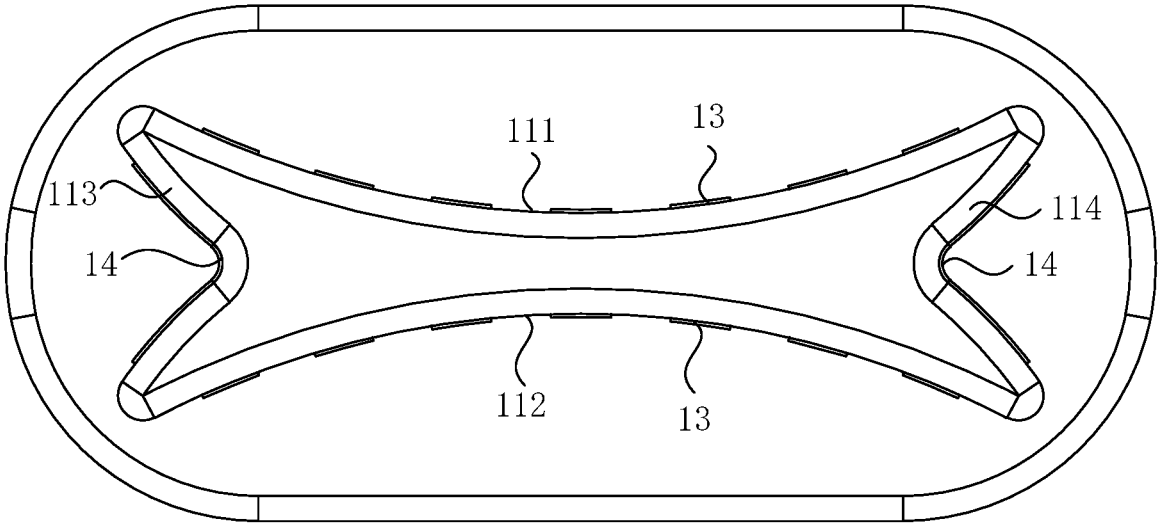
FIG. 3 is a front schematic diagram showing the DC plug according to some embodiments of the present disclosure.

In some embodiments, as shown in FIG. 3, the center contact 11 includes a first center contact side surface 111, a second center contact side surface 112, a third center contact side surface 113 and a fourth center contact side surface 114.

The first center contact side surface 111 and the second center contact side surface 112 are oppositely disposed. The third center contact side surface 113 and the fourth center contact side surface 114 are oppositely disposed.

In some embodiments, the DC plug 1 includes first plug current conductors 13, and the first plug current conductors 13 are disposed on the first center contact side surface 111 and the second center contact side surface 112.

The first center contact side surface 111 and the second center contact side surface 112 are each provided with the first plug current conductor 13, which facilitates realizing the purpose of unlimited forward plugging and reverse plugging of the DC plug 1.

In some embodiments, the DC plug 1 includes second plug current conductors 14, and the second plug current conductors 14 are disposed on the third center contact side surface 113 and the fourth center contact side surface 114.

The third center contact side surface 113 and the fourth center contact side surface 114 are each provided with the second plug current conductor 14, which facilitates realizing the purpose of unlimited forward plugging and reverse plugging of the DC plug 1.

In some embodiments, the first plug current conductors 13 are configured to be connected to one of a positive pole of a power source and a negative pole of the power source, and the second plug current conductors 14 are configured to be connected to the other of the positive pole of the power source and the negative pole of the power source.

In some embodiments, the DC plug 1 includes the center contact 11, one pair of opposite side surfaces of the center contact 11 is provided with the first plug current conductors 13, and another pair of opposite side surfaces of the center contact 11 is provided with the second plug current conductors 14, and the first plug current conductors 13 and the second plug current conductors 14 are adapted to achieve connection with the positive pole and the negative pole of the power source. The form of the DC plug 1 is obviously different from interface products set according to three-phase AC plugs and sockets in the related arts, and is adopt to avoid confusion with the three-phase AC plugs and sockets.

In some embodiments, one pair of opposite side surfaces of the center contact 11 is provided with the first plug current conductors 13, and another pair of opposite side surfaces of the center contact 11 is provided with the second plug current conductors 14, which facilitates realizing unlimited forward plugging and reverse plugging of the DC plug 1.

Optionally, a plurality of plug current conductors is disposed on each center contact side surface, and the current conductors are disposed in a decentralized manner, so as to disperse high current to low current, solve heating problem, increase contact area and reduce contact resistance.

In some embodiments, at least one center contact side surface of the DC plug 1 is set as an arc-shaped surface, so that contact area between the DC plug 1 and the DC socket 2 is larger, which is convenient to realize a better arrangement of the current conductors, and thus the DC plug 1 is smaller in size and stronger in current carrying capacity.

In some embodiments, the first center contact side surface 111 and the second center contact side surface 112 are arc-shaped surfaces or curved surfaces that are recessed towards an inside of the center contact 11.

Furtherly, a radian of the first center contact side surface 111 is consist with that of the second center contact side surface 112, which facilitates realizing indistinction of forward plugging and reverse plugging of the DC plug 1, and the operation is more convenient.

In some embodiments, the third center contact side surface 113 and the fourth center contact side surface 114 are arc-shaped surfaces or curved surfaces that are recessed towards the inside of the center contact 11.

Furtherly, a radian of the third center contact side surface 113 is consist with that of the fourth center contact side surface 114, which facilitates realizing indistinction of forward plugging and reverse plugging of the DC plug 1, and the operation is more convenient.

In some embodiments, the first plug current conductor 13 disposed on the first center contact side surface 111 and the first plug current conductor 13 disposed on the second center contact side surface 112 are symmetrically disposed, which facilitates realizing the purpose of unlimited forward plugging and reverse plugging of the DC plug 1.

In some embodiments, the second plug current conductor 14 disposed on the third center contact side surface 113 and the second plug current conductor 14 disposed on the fourth center contact side surface 114 are symmetrically disposed, which facilitates realizing the purpose of unlimited forward plugging and reverse plugging of the DC plug 1.

In some embodiments, the center contact side surfaces of the center contact 11 are each provided with a plurality of plug current conductors, the plurality of plug current conductors on the same center contact side surface are arranged in sequence and are symmetrical with respect to the center line of this center contact side surface, and the distances from the center line of the center contact side surface to two ends of the center contact side surface are equal. Two ends of a center contact side surface refer to two ends of a direction in which the plurality of plug current conductors are arranged in sequence.

In some embodiments, the number of the first plug current conductors 13 disposed on the first center contact side surface 111 is equal to the number of the first plug current conductors 13 disposed on the second center contact side surface 112.

For example, as shown in FIG. 3, the number of the first plug current conductors 13 disposed on the first center contact side surface 111 and the number of the first plug current conductors 13 disposed on the second center contact side surface 112 are both seven.

Of course, the number of the first plug current conductors 13 on each of the first center contact side surface 111 and the second center contact side surface 112 is not limited to seven, which is more than seven or less than seven, optionally.

In some embodiments, the number of the second plug current conductors 14 disposed on the third center contact side surface 113 is equal to the number of the second plug current conductors 14 disposed on the fourth center contact side surface 114.

For example, as shown in FIG. 3, the number of the second plug current conductors 14 disposed on the third center contact side surface 113 and the number of the second plug current conductors 14 disposed on the fourth center contact side surface 114 are both one.

Of course, the number of the second plug current conductors 14 disposed on each of the second center contact side surface 113 and the third center contact side surface 114 is two, or more than three, optionally.

In some embodiments, the first center contact side surface 111 and the second center contact side surface 112 are each provided with at least three first plug current conductors 13, and the three first plug current conductors 13 are arranged in sequence.

The length of each of the first plug current conductors 13 located in two end regions of the same center contact side surface is greater than the length of the first plug current conductor 13 located in the middle region.

Two ends of a center contact side surface refer to two ends of a direction in which the first plug current conductors 13 are arranged in sequence.

Figure 4:
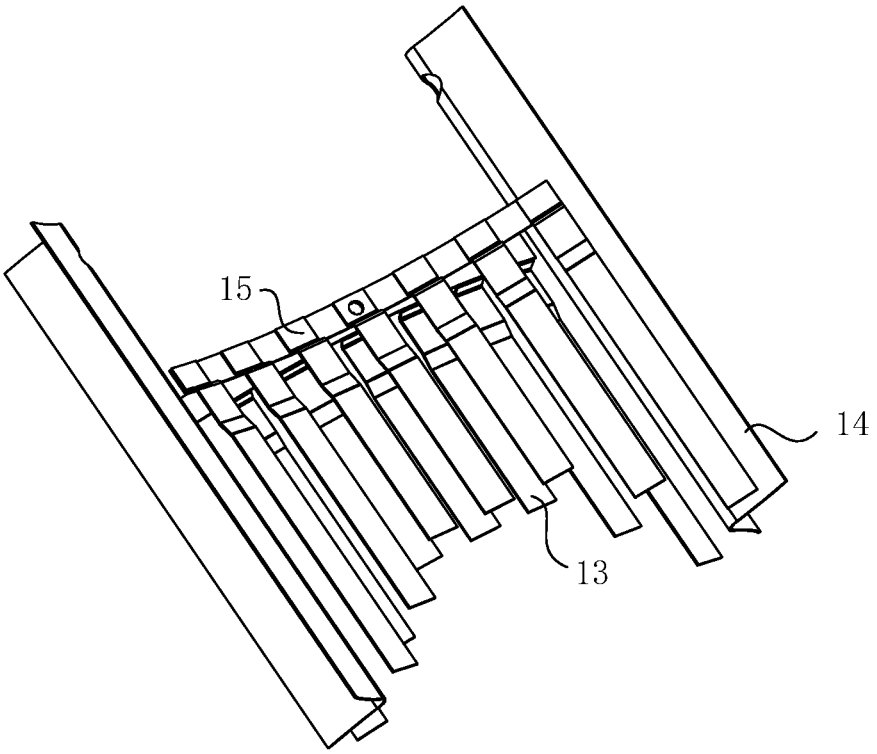
FIG. 4 is a schematic diagram showing plug current conductors according to some embodiments of the present disclosure.

For example, as shown in FIG. 3, the number of the first plug current conductors 13 disposed on each of the first center contact side surface 111 and the second center contact side surface 112 is seven, and the length of each of the first plug current conductors 13 located in two end regions of the same center contact side surface is greater than the length of the first plug current conductor 13 located in the middle region, as shown in FIG. 4.

Furtherly, the first plug current conductors 13 are connected with the positive pole of the power source. The second plug current conductors 14 are connected with the negative pole of the power source.

On the same center contact side surface, the lengths of the first plug current conductors 13 connected to the positive pole are different, which is adopt to make current slowly access in the plugging process, so as not to cause overburning of the current conductors due to excessive contact resistance during the access process.

In some embodiments, as shown in FIG. 4, the DC plug 1 includes third plug current conductors 15.

The first center contact side surface 111 and the second center contact side surface 112 are each provided with at least two first plug current conductors 13. The first plug current conductors 13 located on the first center contact side surface 111 are all connected to a same third plug current conductor 15. The first plug current conductors 13 located on the second center contact side surface 112 are all connected to another same third plug current conductor 15. The third plug current conductors 15 are each provided with a wiring port for connection with a cable.

In some embodiments, the DC plug 1 includes a plug insulating portion 12, the plug insulating portion 12 is connected to a fifth center contact side surface of the center contact 11, the size of the plug insulating portion 12 is greater than that of the center contact 11, the plug insulating portion 12 is configured to enclose the third plug current conductors 15 and the ends of the first plug current conductors 13 connected to the third plug current conductors 15.

In some embodiments, the first center contact side surface 111, the third center contact side surface 113, the second center contact side surface 112, and the fourth center contact side surface 114 of the center contact 11 are side surfaces connected in sequence, and the fifth center contact side surface is in connection with all of the first center contact side surface 111, the second center contact side surface 112, the third center contact side surface 113, and the fourth center contact side surface 114. That is, the fifth center contact side surface is connected to the first center contact side surface 111, the second center contact side surface 112, the third center contact side surface 113, and the fourth center contact side surface 114.

Furtherly, the plug insulating portion 12 and the center contact 11 are made of a same insulating material.

In some embodiments, the center contact 11 and the plug insulating portion 12 are made into a whole, the center contact 11 is adapted to fix the current conductors, and the plug insulating portion 12 is convenient for manual operation. As for the fixing mode, integral molding is adopted, ends of the current conductors are buried in the plug insulating portion 12, which ensures the requirements of safety and appearance.

In some embodiments, one end of each of the second plug current conductors 14 is disposed in the plug insulating portion 12, and the ends of the second plug current conductors 14 located in the plug insulating portion 12 are each provided with a wiring port for connection with a cable.

Furtherly, the first plug current conductors 13 are embedded on the surface of the first center contact side surface 111 and the surface of the second center contact side surface 112. The ends of the first plug current conductors 13 connected to the third plug current conductors 15, and the third plug current conductors 15 are buried in the plug insulating portion 12, and the third plug current conductors 15 are each provided with a wiring port for connection with a cable.

In some embodiments, the first center contact side surface 111, the third center contact side surface 113, the second center contact side surface 112 and the fourth center contact side surface 114 are connected in sequence.

The first center contact side surface 111 and the second center contact side surface 112 are symmetrically disposed, and are all arc-shaped surfaces that are recessed towards the inside of the center contact 11.

The third center contact side surface 113 and the fourth center contact side surface 114 are symmetrically disposed, and are all arc-shaped surfaces that are recessed towards the inside of the center contact 11.

Under the specified current, this structure is adapted to facilitate reasonable distribution of the current conductors, increase contact area of the current conductors, reduce contact resistance, and achieve a larger and safer current-carrying capacity.

In some embodiments, the connection between the first center contact side surface 111 and the third center contact side surface 113, the connection between the third center contact side surface 113 and the second center contact side surface 112, the connection between the second center contact side surface 112 and the fourth center contact side surface 114, and the connection between the fourth center contact side surface 114 and the first center contact side surface 111 are all arc-shaped transitional connection.

Creepage distance refers to a distance of the current conductors connected to the positive pole creep to the current conductors connected to the negative pole along the arc-shaped transitional connection of the center contact 11, the arc-shaped transitional connection of the center contact 11 is adopt to increase the creepage distance, and solve the problem of the creepage distance with smaller volume and compact structure.

In some embodiments, the distance between the two ends of the first center contact side surface 111 is equal to the distance between the two ends of the second center contact side surface 112. Two ends of a center contact side surface refer to two ends of a direction in which the current conductors on the center contact side surface are arranged.

In some embodiments, the distance between the two ends of the third center contact side surface 113 is equal to the distance between the two ends of the fourth center contact side surface 114. Two ends of a center contact side surface refer to two ends of a direction in which the current conductors on the center contact side surface are arranged.

In some embodiments, the distance between the two ends of the first center contact side surface 111 is greater than the distance between the two ends of the third center contact side surface 113, so as to reduce arc discharge and facilitate wiring.

Optionally, the length of the center contact side surface of the center contact 11 adapted to arrange the current conductors connected to the positive pole is greater than the length of the center contact side surface adapted to arrange the current conductors connected to the negative pole, so as reduce arc discharge and facilitate wiring.

In some embodiments, the center contact 11 is flat.

In some embodiments, the center contact 11 itself is of a symmetrical structure.

In some embodiments, the cross section of the center contact 11 is a quadrangle or a variation of the quadrangle.

Optionally, the center contact 11 is of a solid structure.

As shown in FIG. 3, the cross-sectional shape of the center contact 11 is similar to butterfly's wings, so it is called a butterfly-wing type.

In a specific embodiment, the upper and lower surfaces of the butterfly-wing type correspond to the first center contact side surface 111 and the second center contact side surface 112 of the center contact 11. The first plug current conductors 13 embedded on the first center contact side surface 111 and the second center contact side surface 112 are the positive pole of the DC plug 1.

Seven first plug current conductors 13 are embedded on the first center contact side surface 111 at intervals. The lengths of the seven first plug current conductors 13 are different, the lengths of the first plug current conductors disposed at two ends of the first center contact side surface 111 are long, the lengths of the first plug current conductors disposed in the middle are short, and the seven first plug current conductors 13 are uniformly distributed. The seven first plug current conductors 13 on the first center contact side surface 111 are all connected to a same third plug current conductor 15, and the third plug current conductor 15 is adapted to rectify dispersed current, and is connected to a cable through the wiring port.

Seven first plug current conductors 13 are embedded on the second center contact side surface 112 at intervals. The lengths of the seven first plug current conductors 13 are different, the lengths of the first plug current conductors disposed at two ends of the first center contact side surface 111 are long, the lengths of the first plug current conductors disposed in the middle are short, and the seven first plug current conductors 13 are uniformly distributed. The seven first plug current conductors 13 on the second center contact side surface 112 are all connected to another same third plug current conductor 15, and the third plug current conductor 15 is adapted to rectify dispersed current, and is connected to a cable through the wiring port.

In some embodiments, the third plug current conductors 15 are arc-shaped.

In some embodiments, the first plug current conductors 13 are strip-shaped sheets.

In some embodiments, the second plug current conductors 14 are strip-shaped sheets.

The length of the second plug current conductors 14 is greater than the length of the first plug current conductors 13, so as to be buried in the plug insulating portion 12 and facilitate wiring.

In some embodiments, the center contact 11 is of a butterfly-wing type, which is adopt to achieve the following beneficial effects.

For the whole surface, no matter the center contact side surface where the current conductors connected to the positive pole are located or the center contact side surface where the current conductors connected to the negative pole are located, it is configured to a curved surface, so that the contact area of the DC plug and a DC socket is larger, and the positive and negative poles of the current conductors are better arranged.

Since the butterfly-wing type achieves large area contact of the plug and the socket, so that the center contact 11 is made thinner and smaller under the premise of meeting the requirements.

The unique structure of the butterfly-wing type solves the problem of forward plugging and reverse plugging of the DC plug.

Arc-shaped transitional connections of projected parts on the four corners of the center contact 11 is adopt to effectively control the creepage distance between the positive pole and the negative pole.

The creepage distance is a distance between two conductive parts measured along an insulating surface. Under different use cases, as the insulating material around the current conductors is polarized, the insulating material is caused to be charged, and the radius of the charged area is the creepage distance.

Or, the creepage distance can be understood as the shortest path that must be traveled from one current conductor to another current conductor, which is the creepage distance.

The DC plug 1 rectifies the plurality of current conductors connected to the positive pole of the power source, and rectifies the plurality of current conductors connected to the negative pole of the power source.

The DC socket 2 divides the positive pole of the power source into a plurality of parts, i.e., the plurality of current conductors connected to the positive pole of the power source, and divides the negative pole of the power source into a plurality of parts, i.e., the plurality of current conductors connected to the negative pole of the power source.

In some embodiments, the socket is designed according to the shape of the plug. In a contrary design idea, this arrangement is to disperse the rectified current.

Some embodiments provide a DC socket, which is configured to match with the DC plug 1 to supply power to an electrical equipment.

In some embodiments, the DC socket 2 includes a slot 21.

Figure 5:
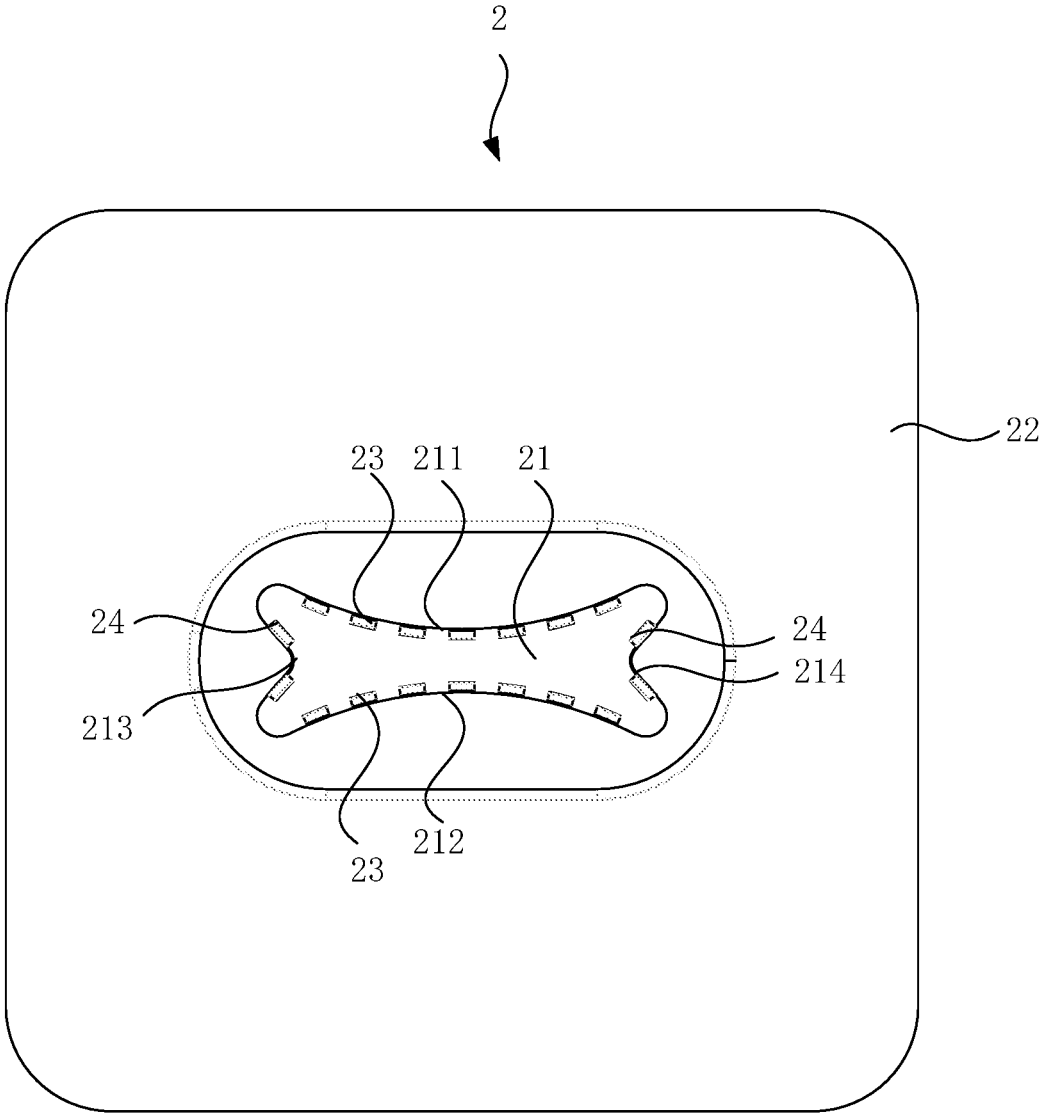
FIG. 5 is a front schematic diagram showing the DC socket according to some embodiments of the present disclosure.

As shown in FIG. 5, the slot 21 includes a first slot side surface 211, a second slot side surface 212, a third slot side surface 213 and a fourth slot side surface 214, wherein the first slot side surface 211 and the second slot side surface 212 are oppositely disposed, and the third slot side surface 213 and the fourth slot side surface 214 are oppositely disposed.

In some embodiments, at least one slot side surface of the DC socket 2 is configured to an arc-shaped surface, so that contact area between the DC socket 2 and the DC plug 1 is larger, which is convenient to realize a better arrangement of the current conductors, and thus the DC plug 1 is smaller in size and stronger in current carrying capacity.

In some embodiments, the DC socket 2 includes first socket current conductors 23, and the first socket current conductors 23 are disposed on the first slot side surface 211 and the second slot side surface 212.

In some embodiments, the DC socket 2 includes second socket current conductors 24, and the second socket current conductors 24 are disposed on the third slot side surface 213 and the fourth slot side surface 214.

In some embodiments, the first socket current conductors 23 are configured to be connected to one of the positive pole of the power source and the negative pole of the power source, and the second socket current conductors 24 are configured to be connected to the other of the positive pole of the power source and the negative pole of the power source.

In some embodiments, the first slot side surface 211 and the second slot side surface 212 are all configured to arc-shaped surfaces that are recessed towards the inside of the slot 21.

In some embodiments, the third slot side surface 213 and the fourth slot side surface 214 are all configured to arc-shaped surfaces that are recessed towards the inside of the slot 21.

In some embodiments, the first socket current conductor 23 on the first slot side surface 211 and the first socket current conductor 23 on the second slot side surface 212 are symmetrically disposed.

In some embodiments, the second socket current conductor 24 disposed on the third slot side surface 213 and the second socket current conductor 24 disposed on the third slot side surface 214 are symmetrically disposed.

In some embodiments, all the slot side surfaces are each provided with a plurality of socket current conductors, the plurality of socket current conductors on the same slot side surface are arranged in sequence and are symmetrical with respect to the center line of this slot side surface, and the distances from the center line of the slot side surface to two ends of the slot side surface are equal.

In some embodiments, the number of the first socket current conductors 23 disposed on the first slot side surface 211 is equal to the number of the first plug current conductors 23 disposed on the second slot side surface 212.

In some embodiments, the number of the second socket current conductors 24 disposed on the third slot side surface 213 is equal to the number of the second socket current conductors 24 disposed on the fourth slot side surface 214. Optionally, the third slot side surface 213 and the fourth slot side surface 214 are each provided with one second socket current conductor 24.

Figure 6:
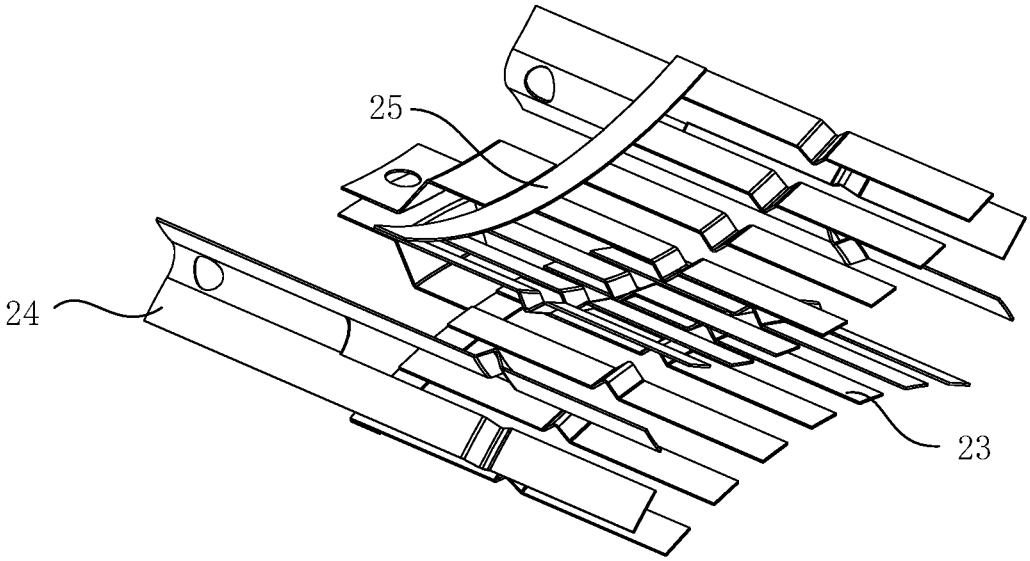
FIG. 6 is a schematic diagram showing socket current conductors according to some embodiments of the present disclosure.

In some embodiments, as shown in FIG. 6, the first slot side surface 211 and the second slot side surface 212 are each provided with at least three first socket current conductors 23, and the length of each of the first socket current conductors 23 located in two end regions of the same slot side surface is greater than each of the length of the first socket current conductors 23 located in the middle region.

In some embodiments, the DC socket includes third socket current conductors 25, the first slot side surface 211 and the second slot side surface 212 are each provided with at least two first socket current conductors 23, the first socket current conductors 23 located on the same slot side surface are connected to a same third socket current conductor 25, and the third socket current conductors 25 are each provided with a wiring port for connection with a cable.

In some embodiments, the DC socket includes a socket insulating portion 22, the slot 21 is disposed in the socket insulating portion 22, and the socket insulating portion 22 is configured to enclose the third socket current conductors 25 and the ends of the first socket current conductors 23 connected to the third socket current conductors 25.

In some embodiments, one end of the second socket current conductor 24 is disposed in the socket insulating portion 12, and this end is provided with a wiring port for connection with a cable.

In some embodiments, the first slot side surface 211, the third slot side surface 213, the second slot side surface 212 and the fourth slot side surface 214 are connected in sequence; the first slot side surface 211 and the second slot side surface 212 are symmetrically disposed, and are all arc-shaped surfaces that are recessed towards the inside of the slot 21; and the third slot side surface 213 and the fourth slot side surface 214 are symmetrically disposed, and are all arc-shaped surfaces that are recessed towards to the inside of the slot 21.

In some embodiments, the connection between the first slot side surface 211 and the third slot side surface 213, the connection between the third slot side surface 213 and the second slot side surface 212, the connection between the second slot side surface 212 and the fourth slot side surface 214, and the connection between the fourth slot side surface 214 and the first slot side surface 211 are all arc-shaped transitional connection.

In some embodiments, the distance between the two ends of the first slot side surface 211 is equal to the distance between the two ends of the second slot side surface 212.

In some embodiments, the distance between the two ends of the third slot side surface 213 is equal to the distance between the two ends of the fourth slot side surface 214.

In some embodiments, the distance between the two ends of the first slot side surface 211 is greater than the distance between the two ends of the third slot side surface 213.

Two ends of a slot side surface refer to two ends of a direction in which the current conductors on the slot side surface are arranged.

In some embodiments, the slot 21 of the DC socket 2 is adaptive to the center contact 11 of the DC plug 1, and correspondingly, the structure of the DC socket 2 is adopt to achieve beneficial effects the same as or similar to the structure of the DC socket 1.

Figure 7:
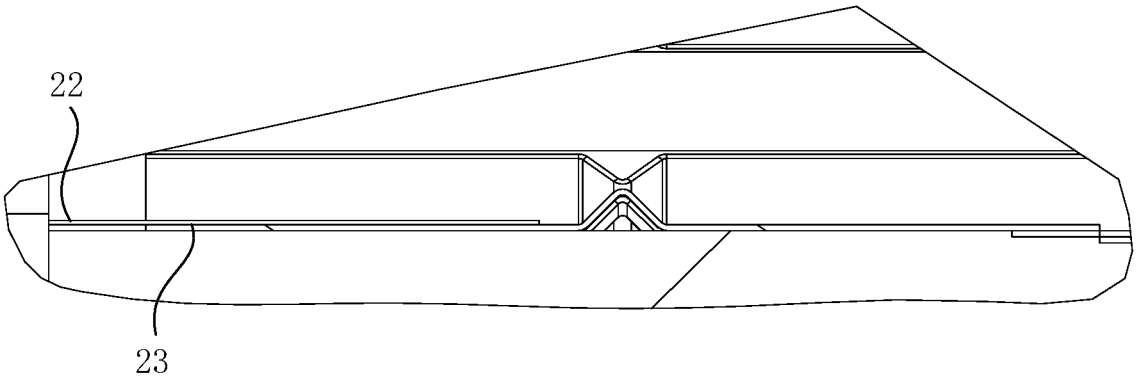
FIG. 7 is a sectional schematic diagram showing a socket current conductor connected to a positive pole of a power source according to some embodiments of the present disclosure.

In the process of plugging the center contact 11 of the DC plug 1 into the slot 21 of the DC socket 2, the current conductors in the slot 21 connected to the positive and negative poles are slightly deformed. As shown in FIG. 7, the deformation way is that there's a square slot between the socket insulating portion 22 and the first socket current conductor 23, and the first socket current conductor 23 is stretched forward, which means that the current conductor is deformed to generate forward deformation, the center contact 11 of the DC plug 1 will restore the deformation after being pulled out, with a slight clamping effect.

Some embodiments further provide an electric equipment, including the DC plug 1 in the above embodiments and/or the DC socket 2 in the above embodiments.

In the description of the present disclosure, it should be understood that the use of terms such as "first" and "second" to define parts is merely for ease of distinguishing the aforementioned parts. Unless otherwise stated, the aforementioned terms do not have special meanings, and thus cannot be understood as limit to the protection scope of the present disclosure.

Finally, it should be noted that the above embodiments are only used to illustrate the technical solutions of the present disclosure, instead of limiting the same. Although the present disclosure has been described in detail with reference to preferred embodiments, those of ordinary skill in the art should understand that the specific embodiments of the present disclosure can be modified or a part of the technical features can be equivalently substituted without departing from the spirit of the technical solutions of the present disclosure, and the modification and substitution should be compassed in the scope of the technical solutions claimed by the present disclosure.

The invention claimed is:

1. A direct current (DC) plug configured to be connected to a DC socket to supply power to an electrical equipment, wherein the DC plug comprises:

a center contact, comprising a first center contact side surface, a second center contact side surface, a third center contact side surface and a fourth center contact side surface, wherein the first center contact side surface and the second center contact side surface are oppositely disposed, and the third center contact side surface and the fourth center contact side surface are oppositely disposed;

a plurality of first plug current conductors, disposed on the first center contact side surface and the second center contact side surface; and a plurality of second plug current conductors, disposed on the third center contact side surface and the fourth center contact side surface;

wherein the plurality of first plug current conductors are configured to be connected to one of a positive pole of a power source and a negative pole of the power source, and the plurality of second plug current conductors are configured to be connected to the other of the positive pole of the power source and the negative pole of the power source;

wherein the first center contact side surface and the second center contact side surface are each provided with at least three first plug current conductors, and a length of each of the at least three first plug current conductors located in two end regions of a same center contact side surface is greater than a length of each of the at least three first plug current conductors located in a middle region of the same center contact side surface.

2. The DC plug of claim 1, wherein the first center contact side surface and the second center contact side surface are arc-shaped surfaces; and the third center contact side surface and the fourth center contact side surface are arc-shaped surfaces.

3. The DC plug of claim 2, wherein the first center contact side surface and the second center contact side surface are arc-shaped surfaces recessed towards an inside of the center contact; and the third center contact side surface and the fourth center contact side surface are arc-shaped surfaces recessed towards the inside of the center contact.

4. The DC plug of claim 1, wherein at least one first plug current conductor disposed on the first center contact side surface and at least one first plug current conductor disposed on the second center contact side surface are symmetrically disposed; and at least one second plug current conductor disposed on the third center contact side surface and at least one second plug current conductor disposed on the fourth center contact side surface are symmetrically disposed.

5. The DC plug of claim 4, wherein all the center contact side surfaces are each provided with a plurality of plug current conductors, the plurality of plug current conductors on a same center contact side surface are arranged in sequence and are symmetrical with respect to a center line of the center contact side surface, and distances from the center line of the center contact side surface to two ends of the center contact side surface are equal.

6. The DC plug of claim 1, further comprising a plurality of third plug current conductors, wherein the first center contact side surface and the second center contact side surface are each provided with at least two first plug current conductors, the at least two first plug current conductors located on a same center contact side surface are connected to a same of at least two third plug current conductor, and the at least two third plug current conductors are each provided with a wiring port for connection with a cable.

7. The DC plug of claim 6, further comprising a plug insulating portion connected to a fifth center contact side surface of the center contact, and the plug insulating portion encloses the at least two third plug current conductors and ends of the at least two first plug current conductors connected to the at least two third plug current conductors.

8. The DC plug of claim 1, wherein the first center contact side surface, the third center contact side surface, the second center contact side surface and the fourth center contact side surface are connected in sequence;

the first center contact side surface and the second center contact side surface are symmetrically disposed, and are arc-shaped surfaces recessed towards an inside of the center contact; and the third center contact side surface and the fourth center contact side surface are symmetrically disposed, and are arc-shaped surfaces recessed towards the inside of the center contact.

9. The DC plug of claim 8, wherein a connection between the first center contact side surface and the third center contact side surface, a connection between the third center contact side surface and the second center contact side surface, a connection between the second center contact side surface and the fourth center contact side surface, and a connection between the fourth center contact side surface and the first center contact side surface are all arc-shaped transitional connections.

10. A direct current (DC) socket for matching with a DC plug to supply power to an electrical equipment, wherein the DC socket comprises:

a slot, comprising a first slot side surface, a second slot side surface, a third slot side surface and a fourth slot side surface, wherein the first slot side surface and the second slot side surface are oppositely disposed, and the third slot side surface and the fourth slot side surface are oppositely disposed;

a plurality of first socket current conductors, disposed on the first slot side surface and the second slot side surface; and a plurality of second socket current conductors, disposed on the third slot side surface and the fourth slot side surface;

wherein the plurality of first socket current conductors are configured to be connected to one of a positive pole and a negative pole of a power source, and the plurality of second socket current conductors are configured to be connected to the other of the positive pole and the negative pole of the power source;

wherein the first slot side surface and the second slot side surface are each provided with at least three first socket current conductors, and a length of each of the at least three first socket current conductors located in two end regions of a same slot side surface is greater than a length of each of the at least three first socket current conductors located in the middle region.

11. The DC socket of claim 10, wherein the first slot side surface and the second slot side surface are arc-shaped surfaces; and the third slot side surface and the fourth slot side surface are arc-shaped surfaces.

12. The DC socket of claim 11, wherein the first slot side surface and the second slot side surface are arc-shaped surfaces recessed towards an inside of the slot; and the third slot side surface and the fourth slot side surface are arc-shaped surfaces recessed towards the inside of the slot.

13. The DC socket of claim 10, wherein at least one first socket current conductor disposed on the first slot side surface and at least one first socket current conductor disposed on the second slot side surface are symmetrically disposed; and at least one second socket current conductor disposed on the third slot side surface and at least one second socket current conductor disposed on the fourth slot side surface are symmetrically disposed.

14. The DC socket of claim 13, wherein all the slot side surfaces are each provided with a plurality of socket current conductors, the plurality of socket current conductors on a same slot side surface are arranged in sequence and are symmetrical with respect to a center line of the slot side surface, and distances from the center line of the slot side surface to two ends of the slot side surface are equal.

15. The DC socket of claim 10, further comprising:

a plurality of third socket current conductors, wherein the first slot side surface and the second slot side surface are each provided with at least two first socket current conductors, the at least two first socket current conductors located on a same slot side surface are connected to a same of at least two third socket current conductor, and the at least two third socket current conductors are each provided with a wiring port for connection with a cable; and a socket insulating portion, wherein the slot is disposed in the socket insulating portion.

16. The DC socket of claim 10, wherein the first slot side surface, the third slot side surface, the second slot side surface and the fourth slot side surface are connected in sequence;

the first slot side surface and the second slot side surface are symmetrically disposed, and are arc-shaped surfaces recessed towards an inside of the slot; and the third slot side surface and the fourth slot side surface are symmetrically disposed, and are arc-shaped surfaces recessed towards the inside of the slot.

17. The DC socket of claim 16, wherein a connection between the first slot side surface and the third slot side surface, a connection between the third slot side surface and the second slot side surface, a connection between the second slot side surface and the fourth slot side surface, and a connection between the fourth slot side surface and the first slot side surface are all arc-shaped transitional connections.

18. An electric equipment, comprising the DC plug of claim 1 and the DC socket of claim 10.

* * * * *